United States Patent [19]

Catani

[11] Patent Number: 4,606,163

[45] Date of Patent: Aug. 19, 1986

[54] APERTURED CHANNEL VENEER ANCHOR

[75] Inventor: Mario J. Catani, Buffalo Grove, Ill.

[73] Assignee: Dur-O-Wal, Inc., Arlighton Heights, Ill.

[21] Appl. No.: 774,072

[22] Filed: Sep. 9, 1985

[51] Int. Cl.[4] ..... E04B 1/38; E04B 1/41

[52] U.S. Cl. ..... 52/434; 52/513; 52/710; 52/713

[58] Field of Search ..... 52/434, 428, 379, 513, 52/710, 487, 713

[56] References Cited

U.S. PATENT DOCUMENTS

| | | | |
|---|---|---|---|
| Re. 15,979 | 1/1925 | Schaefer et al. | 52/379 |
| 1,934,760 | 11/1933 | Awbreg | 52/379 X |
| 2,006,300 | 6/1935 | Kinninger | 52/710 X |
| 2,089,253 | 8/1937 | Fitzgerald | 52/513 X |
| 3,005,293 | 10/1961 | Hunter | 52/487 |

FOREIGN PATENT DOCUMENTS

| | | | |
|---|---|---|---|
| 324451 | 1/1930 | United Kingdom | 52/710 |

OTHER PUBLICATIONS

Burke, Fleming Masonry Anchor System, by The Burke Company, 11/83, Embedded Items, by The Burke Company, p. 116.

*Primary Examiner*—Alfred C. Perham

*Attorney, Agent, or Firm*—Jenner & Block

[57] ABSTRACT

A novel anchor system is provided for connecting backup studs and backup wall systems to veneers such as brick work and the like. The novel anchor system includes an elongated anchor channel for affixation to a backup stud. This arrangement stiffens the combined stud and channel against bending. An anchor tie, connected to the channel, extends for connection to the veneer. When assembled, the stud, the elongate channel, the anchor tie, and the veneer together have a resistance to wind loads and bending which exceeds the sum of the parts.

6 Claims, 9 Drawing Figures

APERTURED CHANNEL VENEER ANCHOR

BACKGROUND OF THE INVENTION

This invention relates generally to wall anchor systems, and more particularly is concerned with a wall anchor system of great strength.

In modern civil construction, wall anchor systems are often used to interconnect outside veneer walls with inner backup wall systems. Typically, an outside veneer wall is formed by bricks laid in lifts or layers and surrounded by mortar in well-known manner. A backup or inner wall can include a number of studs, which can be made of galvanized metal or other suitable construction material. Insulation or moisture-barrier sheathing is often installed between the studs and the veneer.

In modern walls, the inner studs are separated from the outer veneer by a small distance. The veneer wall and the studs are interconnected by anchor ties to provide a completed structure having good rigidity and resistance to wind loading, sagging, and other environmental effects.

Anchor ties are well known. But some such ties are expensive, and do not operate to increase the strength of the wall structure through composite action.

It is the principal object of the present invention to provide an anchor and tie arrangement in which the tie is substantially immobilized, so as to develop a composite interconnection action between the anchor parts and between the wall parts. That interconnection provides an effect in which the completed structure has a strength greater than the sum of its parts.

Another object is to provide an anchor system in which, in one embodiment, an anchor channel extends continuously over the back-up sheathing so as to develop a composite anchor system of great strength.

A related object is to provide an anchor system which develops, in another embodiment, a composite action even though the channel is not continuous over the entire stud.

Still another object is to provide an anchor system which is inexpensive, yet which provides great strength and rigidity during a long service life.

SUMMARY OF THE INVENTION

To accomplish these objectives, the novel anchor system disclosed here includes an elongate anchor channel for affixation to a backup stud. In one embodiment, the channel extends over substantially the entire length of the stud. An anchor tie, rigidly connected to the channel, extends for connection to the veneer. This arrangement stiffens the combined stud, channel and veneer against bending.

Other objects and advantages of the invention will become apparent from reading the following detailed description and upon reference to the drawings. Throughout the drawings, like reference numerals refer to like parts.

DETAILED DESCRIPTION

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
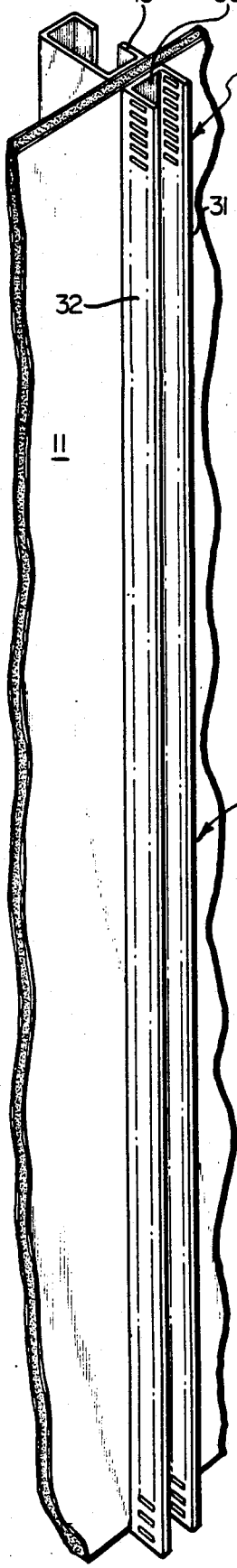
FIG. 1 is a perspective view showing a typical stud and sheathing to which is attached a novel channel member comprising part of the present invention.
Figure 2:
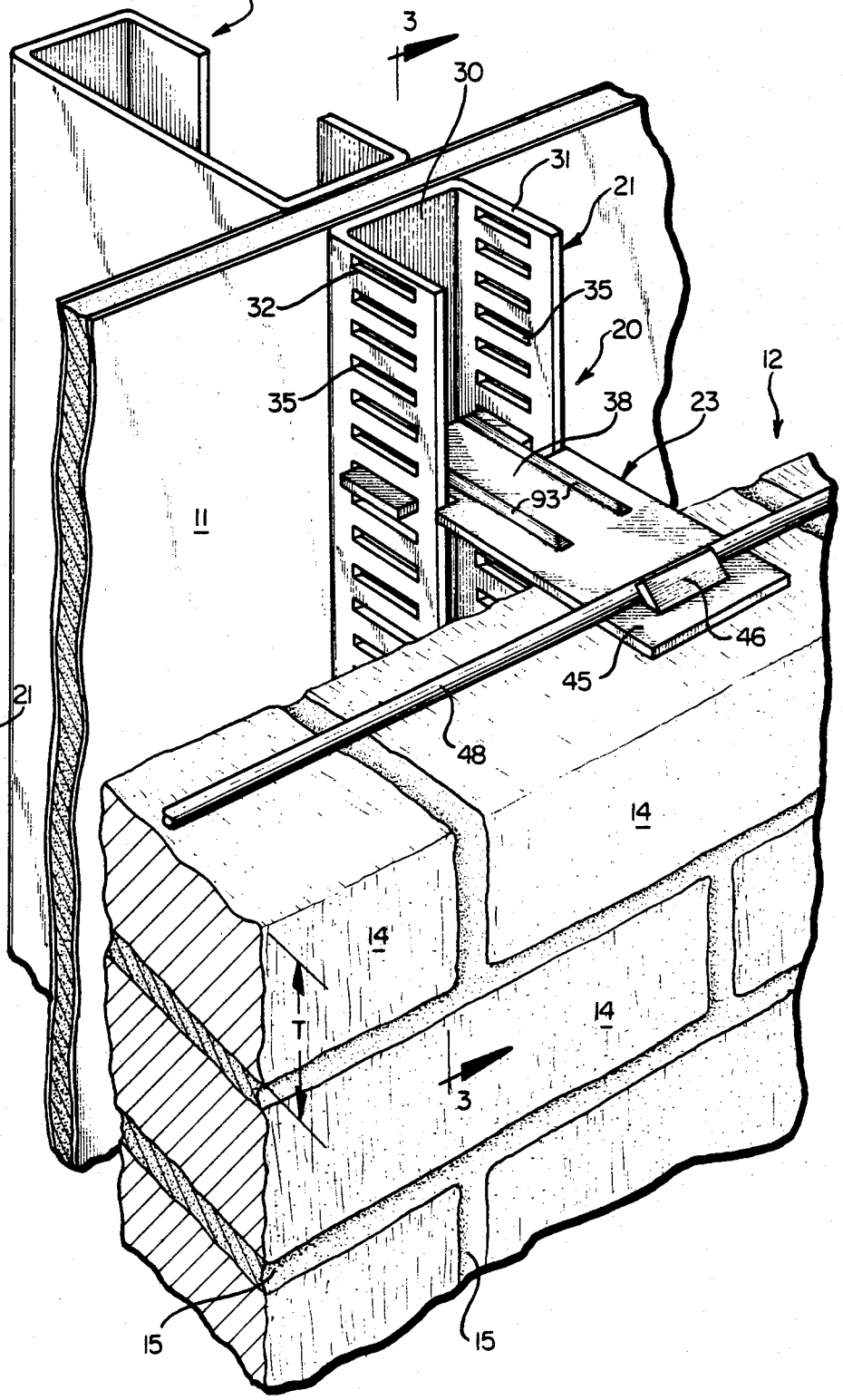
FIG. 2 is a fragmentary perspective view showing the novel channel and an anchor strap of the present invention as they appear in use.

Turning first to FIGS. 1 and 2, there is shown a typical backup stud 10, sheathing 11 and an adjacent veneer wall 12. Here, this veneer 12 is a masonry wall formed of bricks 14 layed in the well-known manner and surrounded by mortar 15. An anchor tie arrangement 20 interconnects the backup stud 10 through the sheathing 11 and the brick veneer wall 12.

This novel anchor arrangement 20 includes an elongate anchor channel 21 affixed to the sheathing 11 and stud 10. Anchor straps 23 connected to the channel 21 extend into the veneer wall 12 for connection to the bricks 14, as especially illustrated in FIGS. 2, 3 and 4.

Figure 8:
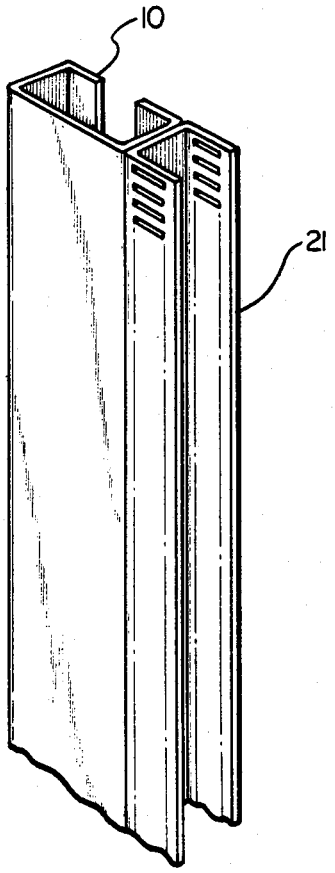
FIG. 8 is a perspective view, in the manner of FIGS. 1 and 2, of an alternate installation of part of the invention.
Figure 9:
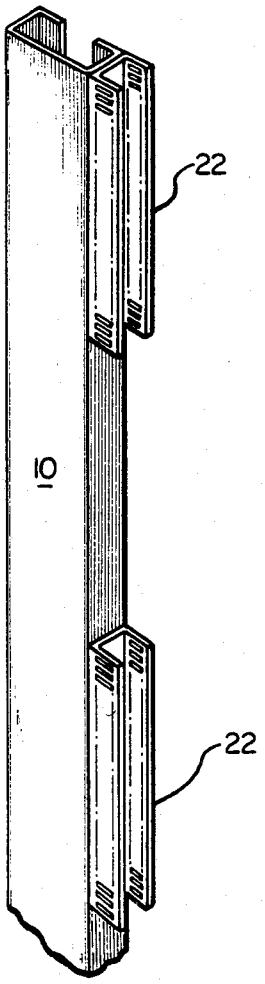
FIG. 9 is a perspective view similar to FIG. 8 but showing an alternate embodiment of the invention.

As noted above, it is an object of the invention to provide an anchoring system which provides great rigidity to the finished structure. To this end, the embodiment of the invention shown in FIGS. 1–4 includes an anchor channel 21 formed as a single piece, and the anchor 21 is affixed to the stud 10 and sheathing 11 over substantially the entire length of the stud. This arrangement stiffens the combined stud 10, channel 21 and bench 12 against bending to a remarkable degree. When sheathing 11 is installed, it is especially useful to use a channel 21 which is continuous or of extended length, as shown in FIG. 1. A continuous channel 21 can also be used when no sheathing is present, as shown in FIG. 8; here, the channel 21 is of course fastened directly to the stud 10. If no sheathing will be present, channel pieces 22 of discrete, limited extent can be mounted to the stud 11 at spaced apart intervals, as shown in FIG. 9.

Figure 5:
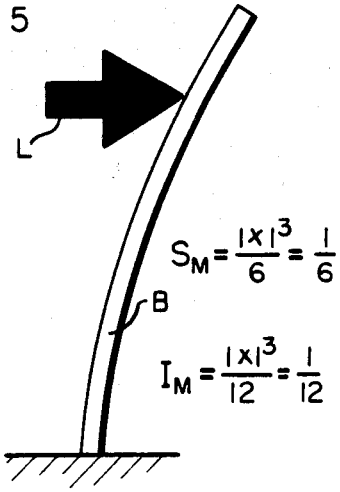
FIG. 5 is a schematic view illustrating the bending occurring in a vertically oriented beam or post when a side load is applied to the beam.
Figure 6:
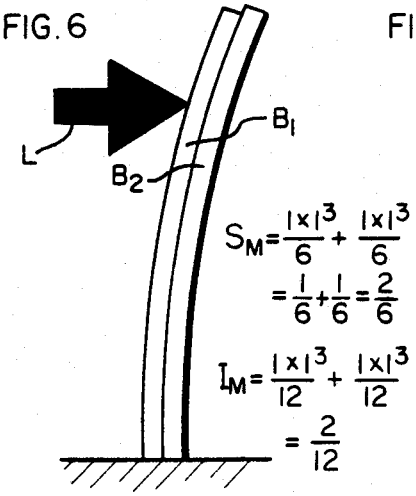
FIG. 6 is a schematic view similar to FIG. 5 and showing the bending which occurs when two such beams are subjected to the side load.
Figure 7:
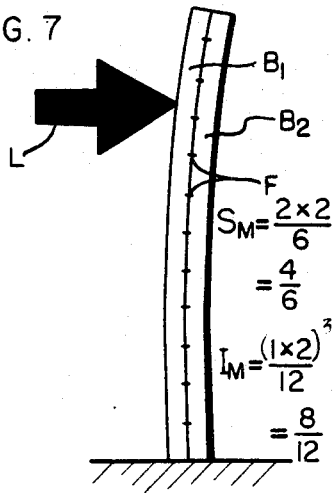
FIG. 7 is a schematic view similar to FIGS. 5 and 6 showing the bending which occurs when two such beams are interconnected and then subjected to the side load.

An explanation of this stiffening action is suggested in FIGS. 5–7 inclusive. Assume that a vertically oriented stud or beam $B_1$ is immobilized at its lower end, and assume that the beam has a sectional area of one inch by one inch. According to well-known principles, the section modulus or bending strength $S_M$ of this beam will be one-sixth inch$^3$ and the moment of inertia or bending stiffness $I_M$ will be one-twelfth inch$^4$. When a wind load or side load L is applied as suggested by the arrow, the beam $B_1$ will deflect by a calculatable amount based on its moment of inertia of one-twelfth inch$^4$.

If two identical beams $B_1$ and $B_2$ are located adjacent one another but are not interconnected, as suggested in FIG. 6, the section modulus or bending strength of the structure will be simply the sum of the section moduli of each of the constituent beams. Thus, the total section modulus here will be two-sixths inches$^3$, and the moment of inertia will be two-twelfths inches$^4$. The aggregate structure will have approximately twice the resistance to bending and deflection when a side load L is applied.

However, if the same two beams $B_1$ and $B_2$ are interconnected by fasteners F as suggested in FIG. 7, the resulting section modulus is the square of the aggregate thickness and the moment of inertia is the cube of the aggregate thickness. Thus, the structure shown in FIG. 7 will have approximately eight times as much resistance to deflection as the single unsupported beam shown in FIG. 5.

This principle is used in accordance with the present invention by fixing the elongated channel 21 over substantially the entire length of the stud 10 and by locking the anchor 23 in narrow slots 35 to prevent substantial movement parallel to or perpendicular to the channel 21 or stud 10. This arrangement stiffens the combined stud channel and veneer against bending, as especially suggested in FIG. 1. In the embodiment of the invention illustrated here, it is contemplated that the channel member 21 will be made in relatively elongated sections, and will be trimmed to the approximate length of the stud 10 in the field. The channel 21 can be affixed to the stud 10 by a continuous gluing process, welding, or by a number of discrete fasteners 25 such as screws or bolts as especially suggested in FIG. 3.

Figure 3:
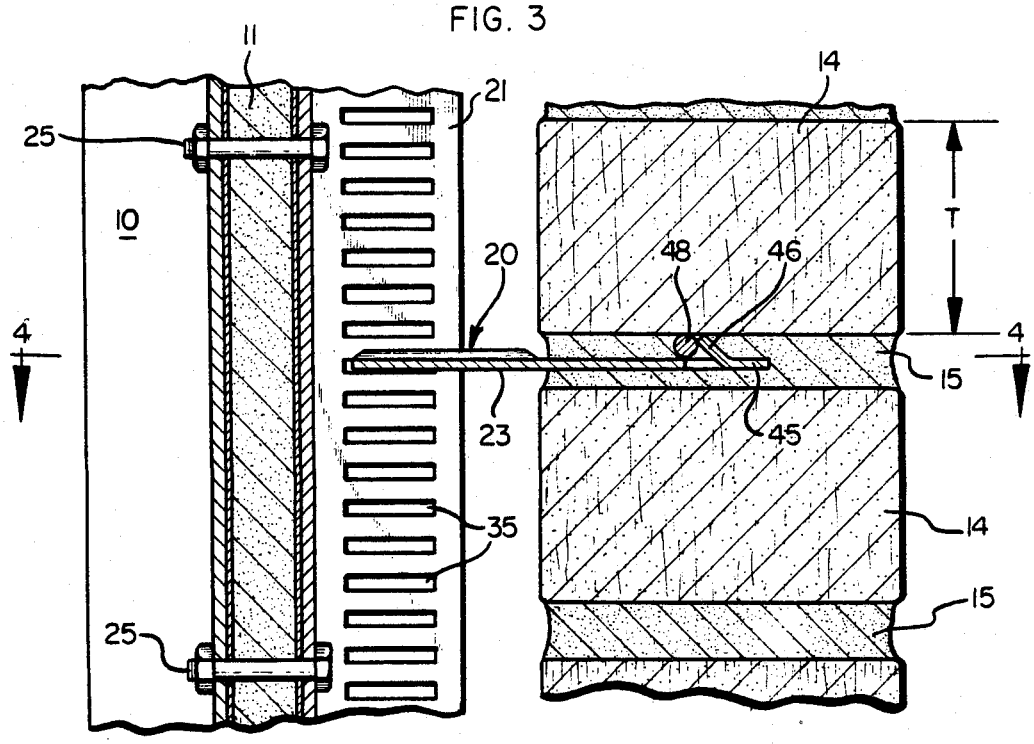
FIG. 3 is a fragmentary sectional view taken substantially in the plane of line 3—3 in FIG. 2.

As shown in FIG. 2, the channel 21 includes a bight portion 30, and two opposed, generally parallel legs 31, 32. Each leg 31, 32 defines a regular array of generally rectangular apertures 35. The apertures 35 are spaced closely together to allow for misalignment between the apertures 35 and the brick veneer bed joint. Thus, each anchor strap 23 can be attached to any one of several apertures 35 so that the strap 23 lies substantially flat across the top of a given brick 14 and is aligned with the top of the brick 14, as shown in FIG. 3. Preferably, each aperture 35 is entirely enclosed within a leg, and the aperture array in one leg 31 is substantially aligned with the aperture array in the other leg 32.

Figure 4:
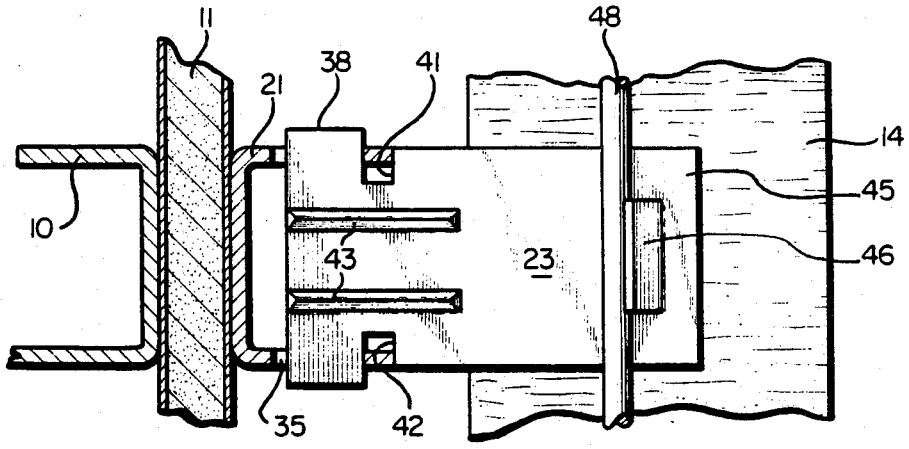
FIG. 4 is a fragmentary sectional view taken substantially in the plane of line 4—4 in FIG. 3.

As suggested especially in FIGS. 2, 3 and 4, the anchor strap 23 is secured to the channel 21 in such a way as to restrict movement perpendicular to the channel 21 and parallel to the longitudinal axis of the stud 10 but to allow limited horizontal movement parallel to the plane of the veneer. To this end, the anchor strap 23 includes a head element 38 adapted to engage and substantially fill opposed apertures 35 in each leg 31, 32. This anchor strap head 38 is partly defined by opposed recesses 41, 42 adapted to closely mate with the apertures 35, as especially suggested in FIGS. 2 and 4, so as to provide a rigid interconnection between the tie 23 and the channel 21. If desired, ridges 43 may be embossed into the strap 23 to stiffen and strengthen it.

At the opposite end of the strap 23, a foot portion 45 is adapted for location inside the veneer wall 12 as shown in FIGS. 2, 3 and 4. If desired, an upstanding tang 46 can be provided to connect an optional pencil rod 48 to the tie strap 23. If a pencil rod is not used, the foot portion 95 can be corrugated or otherwise formed in known manner to engage the bricks and mortar so as to develop the strength of the anchor on the mortar joint.

As explained above, the elongate stud 10 is connected to the elongate channel 21 over extended distances throughout their mutual and mating lengths. And the elongate channel 21 is connected rigidly to the veneer wall 12 at discrete positions spaced substantially over the entire length of the channel 21 and the height of the wall 12. Thus, in further accordance with the invention, a rigid interconnection is provided between the stud 10, the channel 21, the straps 23, and the veneer 12 over the entire height of the structure. A structure of relatively great rigidity and strength is thus provided.

What is claimed is:

1. An anchor system for connecting a veneer to a backup, the backup including at least one elongated stud, the anchor comprising anchor channel means adapted to be affixed to the stud over a plurality of locations and including a bight portion for affixation to the stud and two legs, each leg affixed to the bight portion and defining a regular array of apertures to provide a multiplicity of locations making it possible to accommodate most locations a veneer mortar joints, and anchor tie means including a strap having a head element adapted to engage an aperture in each channel leg for rigid connection to the channel means and extending to the veneer for connection therewith.

2. An anchor system for connecting a veneer to a backup, the backup including at least one vertically elongated stud, the anchor comprising an elongate anchor channel affixed to the stud over substantially the entire length of the stud, whereby to stiffen the combined stud and channel against bending and deflection, the channel including a bight portion for affixation to the stud and two legs, each leg affixed to the bight portion and defining a regular array of apertures to provide a multiplicity of locations making it possible to accommodate most locations of veneer mortar joints, and anchor tie means including a strap having a head element adapted to engage an aperture in each channel leg for rigid connection to the channel means and extending to the veneer for connection therewith.

3. An anchor system according to claim 1 or 2 wherein said anchor strap means further includes a foot portion disposed for location inside the veneer and adapted for connection to a pencil rod located within the veneer structure.

4. An anchor system according to claim 1 or 2 wherein each channel aperture is entirely enclosed within a leg, and in which the aperture array formed in one channel leg is aligned with the aperture array in the other leg.

5. An anchor system according to claim 4 wherein said anchor strap head is partly defined by opposed recesses adapted to rigidly mate with an aperture, so as to provide an interconnection between the stud, the channel means, the strap means, and the veneer.

6. An anchor system according to claim 1 or 2 further including attachment means for attaching the channel member bight portion to the stud at a plurality of regularly spaced-apart positions.

* * * * *